US007434811B1

(12) United States Patent
Coburn et al.

(10) Patent No.: US 7,434,811 B1
(45) Date of Patent: Oct. 14, 2008

(54) PROJECTILE TRAP AND SHOOTING RANGE

(75) Inventors: Ronald Coburn, Spofford, NH (US); Charles Edward Nester, Pittsfield, MA (US); Christopher John Killoy, Hampden, MA (US)

(73) Assignee: Savage Range Systems, Inc., Westfield, MA (US)

( * ) Notice: Subject to any disclaimer, the term of this patent is extended or adjusted under 35 U.S.C. 154(b) by 0 days.

(21) Appl. No.: 11/452,091

(22) Filed: Jun. 13, 2006

(51) Int. Cl.
*F41J 1/12* (2006.01)
*F41J 1/18* (2006.01)

(52) U.S. Cl. ..... 273/410; 273/404

(58) Field of Classification Search ..... 273/404–410
See application file for complete search history.

(56) References Cited

U.S. PATENT DOCUMENTS

| | | | | |
|---|---|---|---|---|
| 4,164,901 | A * | 8/1979 | Everett | 454/228 |
| 4,598,631 | A * | 7/1986 | Everett | 454/237 |
| 4,683,688 | A * | 8/1987 | Wojcinski | 52/79.1 |
| 5,070,763 | A | 12/1991 | Coburn | 89/36.02 |
| 5,088,741 | A * | 2/1992 | Simonetti | 273/410 |
| 5,113,700 | A | 5/1992 | Coburn | 89/36.02 |
| 5,121,671 | A | 6/1992 | Coburn | 89/36.02 |
| 5,486,008 | A | 1/1996 | Coburn | 273/410 |
| 5,564,712 | A * | 10/1996 | Werner | 273/410 |
| 5,746,022 | A | 5/1998 | Brown et al. | 47/57.6 |
| 5,811,718 | A * | 9/1998 | Bateman | 89/36.02 |
| 5,902,182 | A * | 5/1999 | Kramer | 454/255 |
| 6,530,572 | B1 * | 3/2003 | Overley | 273/410 |
| 6,732,628 | B1 | 5/2004 | Coburn et al. | 89/36.02 |
| 2006/0208424 | A1 * | 9/2006 | Sovine et al. | 273/410 |
| 2007/0210522 | A1 * | 9/2007 | Halverson | 273/404 |

OTHER PUBLICATIONS

Vargas, Clark, "Design Criteria for Shooting Ranges," http://www.rangeinfo.org/resource_library/resLibDoc.cfm?filename=facility_mngmnt/design/design_criteria.htm &CAT=Facility.

* cited by examiner

*Primary Examiner*—Mark S Graham
(74) *Attorney, Agent, or Firm*—MacCord Mason PLLC

(57) ABSTRACT

A shooting range that may include one or more of a shooting station, a projectile trap and or at least one range auxiliary. In one embodiment of the inventions, the projectile trap includes a trap chamber, an air injection system and an air collection system.

39 Claims, 3 Drawing Sheets

PROJECTILE TRAP AND SHOOTING RANGE

BACKGROUND (1) Field of the Disclosure

This disclosure relates to shooting ranges of the kind including a projectile trap and a projectile trap for varied uses, including for use in a shooting range.

(2) Description of Prior Art

The design and operation of shooting ranges is a sophisticated engineering matter in which safety is paramount. Thorough discussions of the design and layout of modern shooting ranges may be found in "Design Criteria for Shooting Ranges" by C. Vargas, Third National Shooting Range Symposium (1996); Army Regulation AR 385-63 "Range Safety"; Navy Handbook (MIL-HDBK) 1027/3B, "Range Facilities and Miscellaneous Training Facilities Other Than Buildings" and the National Rifle Association's "NRA Range Source Book." These references are hereby incorporated by reference in their entirety.

Shooting ranges having projectile traps are known. Heretofore, the traps have included various apparatuses for preventing fragments of lead and other metals from escaping the traps and becoming a hazard to health and the environment. Both liquid and dry systems are popular. Examples of such systems, commonly owned by the applicant, are described in U.S. Pat. Nos. 5,070,763, 5,113,700, 5,121,671 and 5,486,008 issued to Coburn.

One such prior art dry system apparatus produces a negative air pressure within the trap, but this has proven unsatisfactory because the negative air pressure may unnecessarily pull lead from the trap that would otherwise be removed by a collection system at the bottom of the trap. Thus, this kind of system may actually increase, rather than reduce, contamination problems resulting from lead and other metals. Also creating the negative air pressure system is energy consumptive due to the high volume of air flow needed. Thus, this kind of prior art projectile trap leaves much to be desired.

SUMMARY

This disclosure is directed to a shooting range including a shooting station and a projectile trap. In an embodiment, the shooting range includes one or more range auxiliary systems. Also, in an embodiment, the projectile trap includes a trap chamber, an air injection system and an air collection system.

Accordingly, an embodiment of the range provides at least one shooting station and at least one projectile trap having a trap chamber and an air injection system positioned upstream of the trap chamber.

An embodiment of the projectile trap includes a trap chamber, an air injection system positioned upstream of the trap chamber and an air collection system positioned downstream of the air injection system for receiving at least a portion of the air from the air injection system, where 'upstream' and 'downstream' refer to the direction of projectile travel.

Other embodiments of the range include at least one shooting station, at least one projectile trap and at least one range auxiliary system. The projectile trap includes: a trap chamber; an air injection system positioned upstream of the trap chamber; and an air collection system positioned downstream of the air injection system for receiving at least a portion of the air from the air injection system.

In certain embodiments, the trap further includes a trap guide and the air injection system is adjacent to the trap guide and includes one or more outlets in the form of a slot oriented toward the chamber. Also, the collection system is downstream of the injection system and upstream of the chamber and may also include one or more air inlets in the form of a slot oriented toward the chamber. In addition, the collection system may have an operating CFM equal to or greater than that of the injection system. Moreover, the trap guide may be a pair of opposed ramps, each ramp optionally having an angle between about 5° and 25° from horizontal. Furthermore, in embodiments of the apparatus, the chamber may be a deceleration chamber including an inlet and an inner curved surface for receiving and reducing the velocity of a projectile.

Accordingly, one aspect of the disclosure is to provide a shooting range including at least one shooting station and at least one projectile trap having a trap chamber and an air injection system positioned upstream of the trap chamber.

Another aspect of the disclosure is to provide a projectile trap including a trap chamber, an air injection system positioned upstream of the trap chamber, and an air collection system positioned downstream of the air injection system for receiving at least a portion of the air from the air injection system.

Yet another aspect is to provide a shooting range including: at least one shooting station; at least one projectile trap having (a) a trap chamber; (b) an air injection system positioned upstream of the trap chamber; and (c) an air collection system positioned downstream of the air injection system for receiving at least a portion of the air from the air injection system; and at least one range auxiliary system.

These and other embodiments of the apparatuses will become apparent to those skilled in the art after a reading of the following description of the embodiments when considered with the drawings.

DESCRIPTION OF VARIOUS EMBODIMENTS

Figure 1:
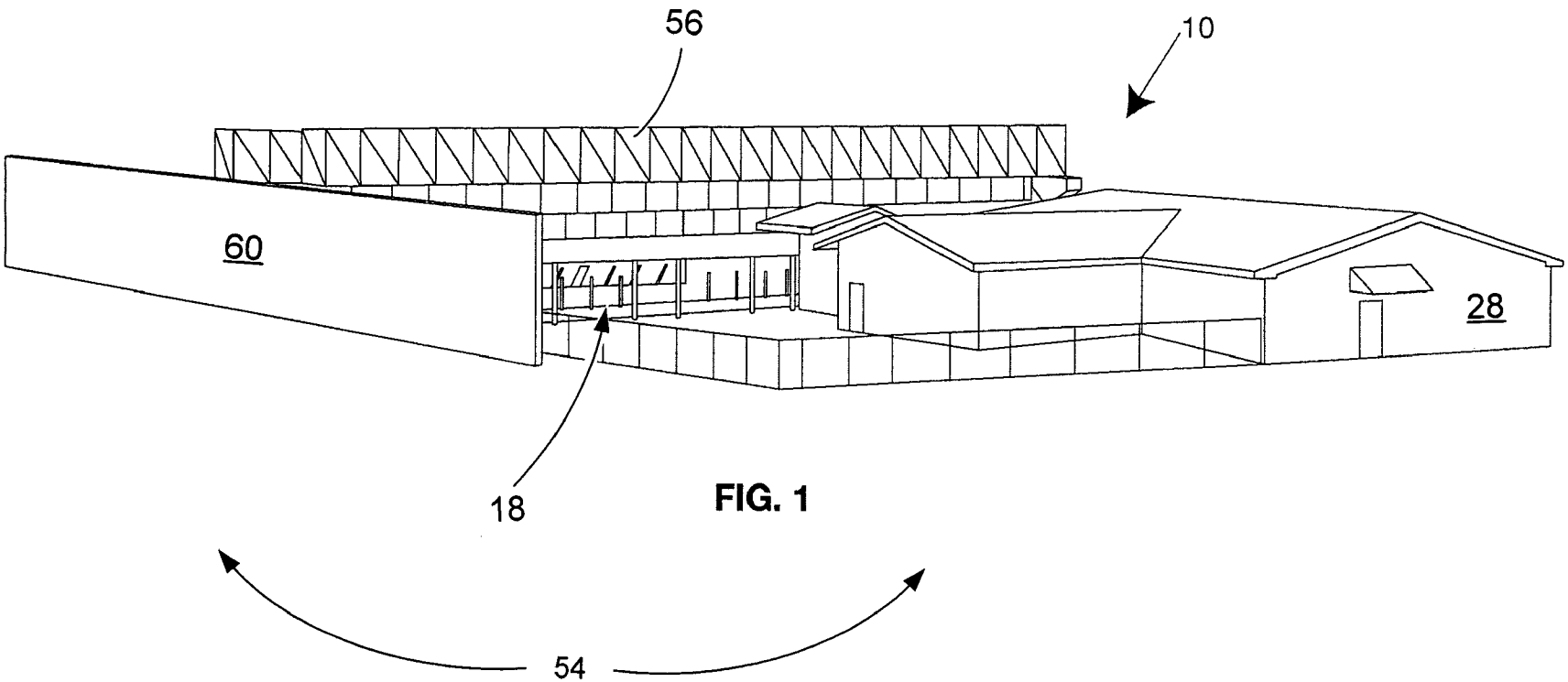
FIG. 1 is a top perspective view of a shooting range constructed according to the present inventions.

In the following description, like reference characters designate like or corresponding parts throughout the several views. Also in the following description, terms such as "forward," "left," and "downwardly," are words of convenience and are not limiting terms. The illustrations provided are for describing embodiments of a shooting range and do not limit the range to any particular embodiment shown or described.

FIG. 1 shows an embodiment of a shooting range, generally designated 10, constructed according to the present inventions. The shooting range 10 includes a safety area 28 where firearms may be inspected and readied. In addition, range management may have offices adjacent or in the safety area 28. Limited access to the shooting range 10 may be provided by additional fencing and supplemented, in part, by a containment system, generally designated 54.

Figure 2:
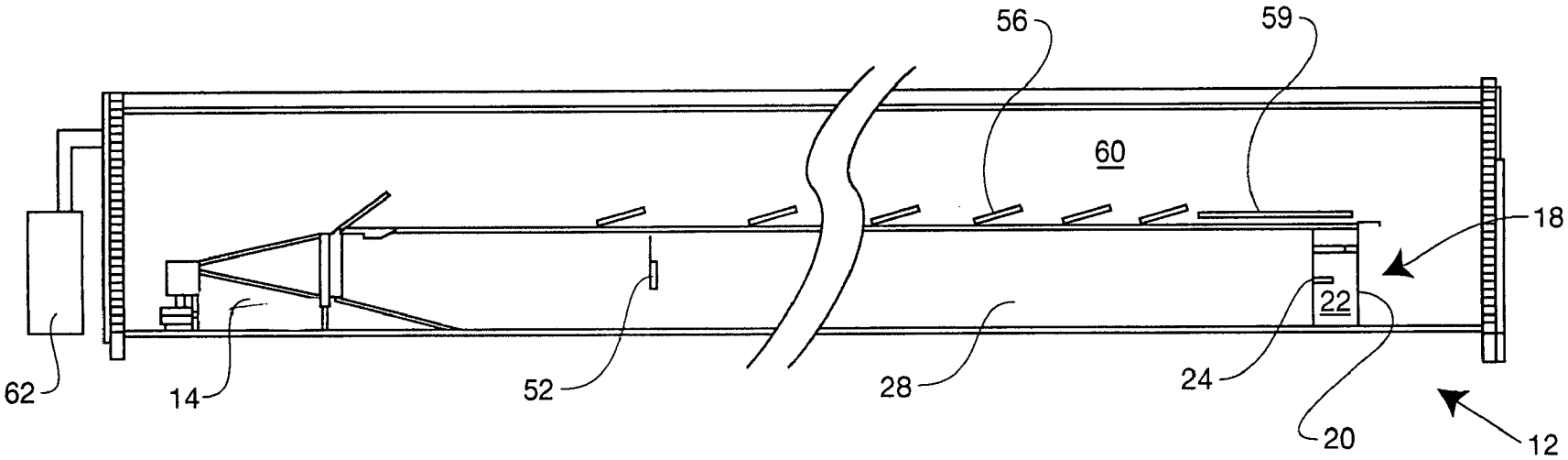
FIG. 2 is a cross-sectional side view of a portion of the shooting range.

FIG. 2 is a cross-sectional view of a portion of shooting range 10. FIG. 2 shows a shooting station 12, a projectile trap 14 and at least one range auxiliary system that may include: a targeting system 52; a containment system 54 that may optionally include one or more sidewalls, such as the wall 60, overhead baffles 56, and or a safety ceiling 59; or a heating ventilation air conditioning (HVAC) system 62 and combinations thereof. The shooting station 12 may include one or more of a firing position 18 and a shooting booth 20 that may optionally include a weapon rest 24 and or a lane divider 22.

Figure 3:
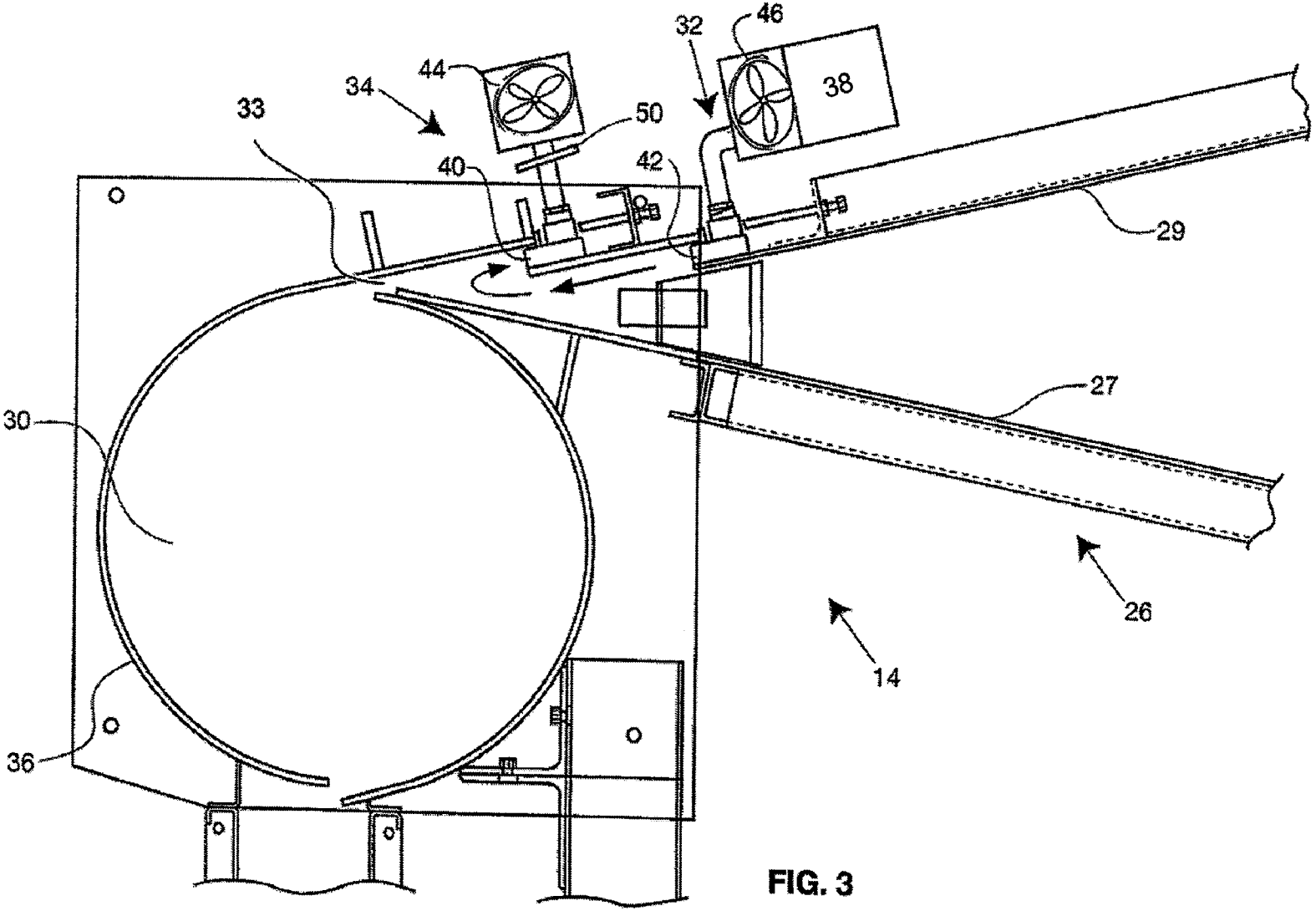
FIG. 3 is an enlarged cross-section side view of a projectile trap for use in the shooting range.

FIG. 3 shows a projectile trap 14 including a trap chamber 30, an air injection system 32 positioned upstream, in reference to the direction of projectile travel, of the trap chamber 30, and an air collection system 34 downstream of the injection system 32 that may optionally include an air filter 50. In an embodiment of the projectile trap 14, the chamber 30 includes an inlet 33 and an inner curved surface 36 for receiving a projectile and reducing its velocity through contact with the surface 36. The injection system 32 shown may include an air supply 38, air inlets, such as the inlet 42, which is shaped as a slot and oriented toward the chamber 30, and air outlets, such as the outlet 40, which is also shaped as a slot and is also oriented towards the chamber 30. The collection system 34 may optionally include an exhaust fan 44 having an operating CFM equal to or greater than that of an injection fan 46 to aid in controlling the direction and velocity of the air from the air injection system.

In embodiments, the projectile trap 14 may also include a trap guide 26 wherein the injection system 32 is adjacent the guide 26 and the collection system 34 is upstream of the chamber 30. The guide 26 may be a pair of opposed ramps 27 and 29 with each ramp having an angle between about 5° and 25° from horizontal.

Certain modifications and improvements may occur to those skilled in the art upon a reading of the foregoing description. By way of example, while the shooting range shown includes a circular projectile deceleration chamber, other types of traps could be used, including, without limitation, the kind having a impact plate design. Also, the location of the air outlets and inlets can be modified. For instance, while the inlet and outlet is shown above the inlet to the chamber in FIG. 3, one or both of them can be located below the inlet, or an inlet and outlet may be below corresponding, respectively, to an outlet and inlet above in order to provide some cross-flow across the inlet of the projectile trap. Also, in some applications it may be practical to induct air from a sidewall adjacent to the projectile trap, rather than from above the chamber inlet. All such modifications and improvements have not been included herein for the sake of conciseness and readability but may properly fall within the scope of the appended claims.

We claim:

1. A projectile trap comprising:

(a) a trap chamber;

(b) an air injection system positioned upstream of the trap chamber;

(c) an air collection system positioned downstream of the air injection system for receiving at least a portion of the air from the air injection system; and (d) a trap guide and wherein the air injection system is adjacent to the trap guide and the air collection system is downstream of the air injection system and upstream of the trap chamber.

2. The projectile trap according to claim 1, wherein the trap guide includes at least one pair of opposed ramps.

3. The projectile trap according to claim 2, wherein the angle of each ramp is between about 5° and 25° from horizontal.

4. The projectile trap according to claim 1, wherein the trap chamber is a deceleration chamber.

5. The projectile trap according to claim 4, wherein the deceleration chamber includes an inlet and an inner curved surface for receiving the projectile wherein the velocity of the projectile is reduced by contact with the inner curved surface.

6. The projectile trap according to claim 1, wherein the air injection system includes an air supply and at least one air outlet.

7. The projectile trap according to claim 6, wherein the at least one air outlet includes a plurality of spaced apart air outlets.

8. The projectile trap according to claim 7, wherein the plurality of spaced apart air outlets are slots.

9. The projectile trap according to claim 6, wherein the at least one air outlet is oriented towards the trap chamber.

10. The projectile trap according to claim 1, wherein the air collection system includes at least one air inlet.

11. The projectile trap according to claim 10, wherein the at least one air inlet includes a plurality of spaced apart air inlets.

12. The projectile trap according to claim 11, wherein the plurality of spaced apart air inlets are slots.

13. The projectile trap according to claim 10, wherein the at least one air inlet is oriented towards the trap chamber.

14. The projectile trap according to claim 1, wherein the air collection system further includes at least one exhaust fan.

15. The projectile trap according to claim 14, wherein the operating CFM of the air collection system is greater than or equal to the operating CFM of the air injection system.

16. The projectile trap according to claim 1, wherein the air collection system further includes at least one air filter.

17. A shooting range comprising:

(a) at least one shooting station;

(b) at least one projectile trap having (i) a trap chamber; (ii) an air injection system positioned upstream of the trap chamber; (iii) an air collection system positioned downstream of the air injection system for receiving at least a portion of the air from the air injection system; (iv) and a trap guide and wherein the air injection system is adjacent to the trap guide and the air collection system is downstream of the air injection system and upstream of the trap chamber and (c) at least one range auxiliary system.

18. The shooting range according to claim 17, wherein the range auxiliary system is a targeting system.

19. The shooting range according to claim 17, wherein the range auxiliary system is a containment system.

20. The shooting range according to claim 19, wherein the containment system includes side walls, a safety ceiling and overhead baffles.

21. The shooting range according to claim 17, wherein the range auxiliary system is a HVAC system.

22. The shooting range according to claim 17, wherein the shooting station includes a firing position.

23. The shooting range according to claim 22, wherein the shooting station further includes a shooting booth.

24. The shooting range according to claim 23, wherein the shooting booth includes a weapon rest and at least one lane divider.

25. The projectile trap according to claim 17, wherein the trap guide includes at least one pair of opposed ramps.

26. The projectile trap according to claim 25, wherein the angle of each ramp is between about 5° and 25° from horizontal.

27. The projectile trap according to claim 17, wherein the trap chamber is a deceleration chamber.

28. The projectile trap according to claim 27, wherein the deceleration chamber includes an inlet and an inner curved surface for receiving the projectile wherein the velocity of the projectile is reduced by contact with the inner curved surface.

29. The projectile trap according to claim 17, wherein the air injection system includes an air supply and at least one air outlet.

30. The projectile trap according to claim 29, wherein the at least one air outlet includes a plurality of spaced apart air outlets.

31. The projectile trap according to claim 30, wherein the plurality of spaced apart air outlets are slots.

32. The projectile trap according to claim 29, wherein the at least one air outlet is oriented towards the trap chamber.

33. The projectile trap according to claim 17, wherein the air collection system includes at least one air inlet.

34. The projectile trap according to claim 33, wherein the at least one air inlet includes a plurality of spaced apart air inlets.

35. The projectile trap according to claim 34, wherein the plurality of spaced apart air inlets are slots.

36. The projectile trap according to claim 33, wherein the at least one air inlet is oriented towards the trap chamber.

37. The projectile trap according to claim 17, wherein the air collection system further includes at least one exhaust fan.

38. The projectile trap according to claim 37, wherein the operating CFM of the air collection system is greater than or equal to the operating CFM of the air injection system.

39. The projectile trap according to claim 17, wherein the air collection system further includes at least one air filter.

* * * * *